US005842434A

United States Patent [19]

Lange et al.

[11] Patent Number: 5,842,434

[45] Date of Patent: Dec. 1, 1998

[54] MOORING ASSEMBLY

[75] Inventors: Espen Lange, Oslo; Dag Aavitsland, Stabekk, both of Norway

[73] Assignee: Kvaerner Engineering AS, Lysaker, Norway

[21] Appl. No.: 894,468

[22] PCT Filed: Feb. 21, 1996

[86] PCT No.: PCT/NO96/00040

§ 371 Date: Aug. 20, 1997

§ 102(e) Date: Aug. 20, 1997

[87] PCT Pub. No.: WO96/26861

PCT Pub. Date: Sep. 6, 1996

[30] Foreign Application Priority Data

Feb. 28, 1995 [NO] Norway ..... 950775

[51] Int. Cl.[6] ..... B63B 21/00

[52] U.S. Cl. ..... 114/230; 114/293

[58] Field of Search ..... 114/230, 293; 441/3–5

[56] References Cited

U.S. PATENT DOCUMENTS 3,414,918 12/1968 Petrie et al. ..... 441/5
3,774,562 11/1973 Dean, III .
4,305,341 12/1981 Stafford .
4,892,495 1/1990 Svensen ..... 441/5
5,170,737 12/1992 Poldervaart .

FOREIGN PATENT DOCUMENTS 2 594 406 8/1987 France .
176 395 12/1994 Norway .

*Primary Examiner*—Stephen Avila
*Attorney, Agent, or Firm*—Young & Thompson

[57] ABSTRACT

A mooring assembly for an offshore floater comprises a vertical shaft (4) in the floater (1), a rotating part (5) rotatably mounted in the vertical shaft about a vertical axis, a number of mooring cables (16) extending from the rotating part down to the seabed, and a device (17) aboard the floater (1) for tightening/slackening the mooring cables. Each mooring cable (15, 16) is secured, right below the rotating part (5), to a rigid body (13) having two ends, one end being connected by a universal swivel joint (12) to the rotating part (5) and the other end comprising a locking device (14) for locking the mooring line to the rigid body (13).

6 Claims, 3 Drawing Sheets

MOORING ASSEMBLY

FIELD OF THE INVENTION

The invention relates to a mooring assembly for an offshore floater, said assembly comprising a vertical shaft in the floater, a rotating part rotatably mounted about a vertical axis in the vertical shaft, a number of mooring cables extending from the rotating part down to the seabed, and means aboard the floater for tightening/slackening the mooring cables.

BACKGROUND OF THE INVENTION

If a floater is moored offshore by means of a rotating part rotatably mounted in a vertical shaft, said rotating part will, when the floater moves, be pulled along with it as a result of inertia and frictional forces in the bearings of the rotating part in the shaft. The mooring cables, which are brought up into the rotating part, will be exposed to wear and tear, and every endeavor is therefore made to use good rotational bearing components which enable the rotating part to rotate easily in relation to the floater.

The use of "inferior" bearing would be simpler and less expensive but would give an undesired large cable divergence, with correspondingly greater wear of the mooring cables.

SUMMARY OF THE INVENTION

An object of the invention is to make possible the use of simpler and less expensive bearings for said rotating part without thereby exposing the mooring cables to greater hazard of wear.

According to the invention, a mooring assembly, as mentioned by way of introduction, is therefore proposed, said mooring assembly being characterized in that each mooring cable right below the rotating part is secured to a rigid body having two ends, one end being connected by a universal swivel joint to said rotating part and the other end comprising a locking device for locking the mooring line to the rigid body.

When the floater revolves about the rotating part under the influence of wind and current, said rotating part will, as noted, have a tendency to be pulled along during a part of the revolving movement, as a result of inertia and frictional forces. Since the mooring line is brought into the rotating part by means of the swivel-mounted rigid body, moments will arise from the pointing movement, said moments resulting in the rotating part being held back with greater force. This means that the rotational bearings of the rotating part can be made simpler and less expensive since there is decreased dependency upon smoothly operating bearings for the rotating part in the vertical shaft of the floater.

The angle of divergence between the rigid body and the mooring cable will decrease corresponding to the increase in length of the rigid body.

The rotational bearings of the rotating part of the floater may advantageously comprise slide bearings.

The locking device for locking the mooring cable to the rigid body may advantageously be an activable chain stopper. This presupposes that the mooring cable comprises a length of chain for engagement with the chain stopper in the rigid body.

It is particularly advantageous according to the invention that it is possible, from each location on the rotating part to which a rigid body is connected, to form a vertical guide track, in the rotating part, for an elongated flexible element extending from a tightening/slackening device mounted on the floater, such as a winch, said tightening/slackening device being rotatable about an axis, at least approximately vertical, coinciding with the flexible element extending toward the device, for the removal of possible twists in the flexible elongated element, which is connected to the mooring cable or constitutes the mooring cable.

BRIEF DESCRIPTION OF THE DRAWINGS

The invention shall now be further explained by reference to the drawings, wherein.

DETAILED DESCRIPTION OF THE INVENTION

Figure 1:
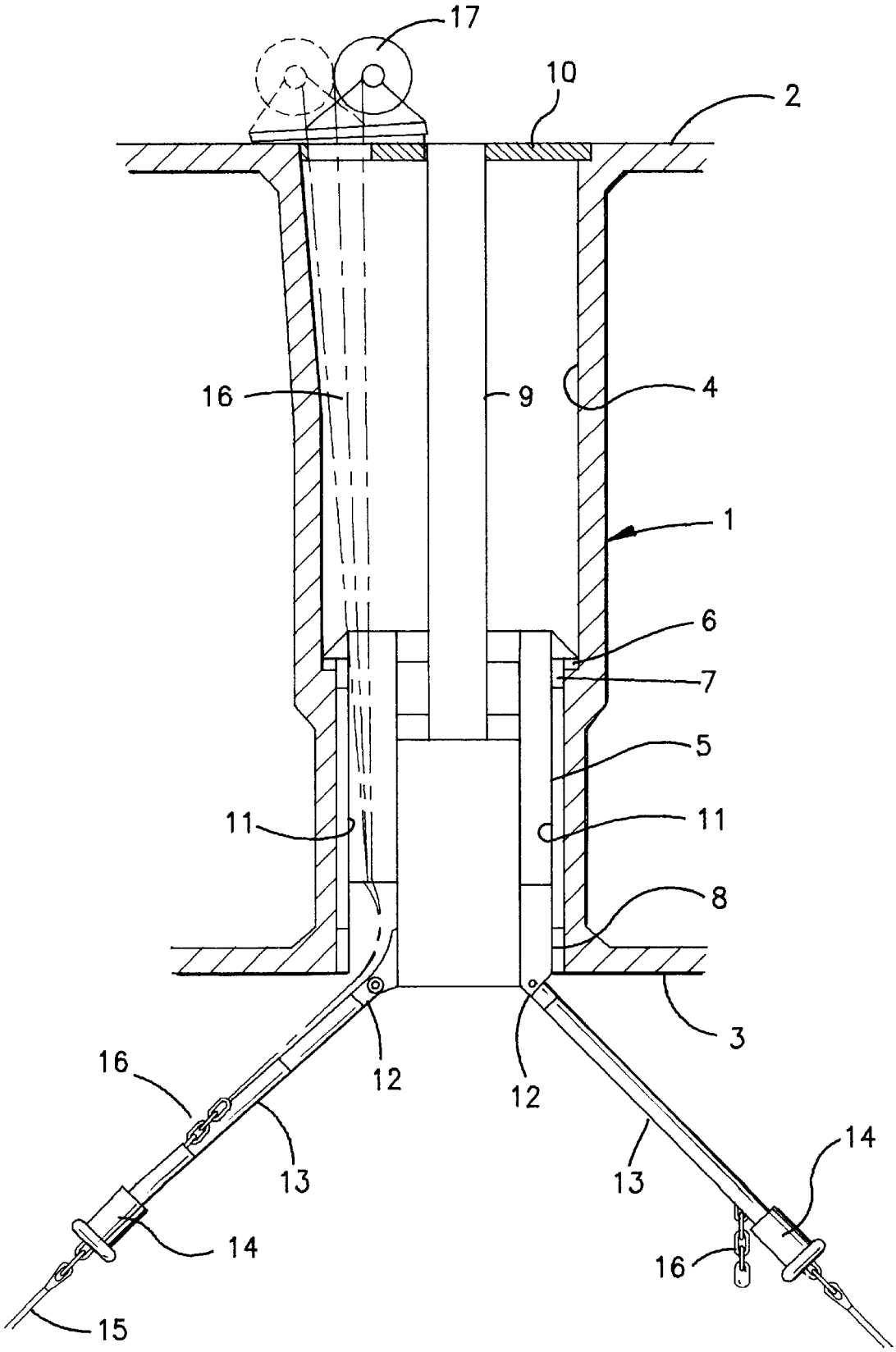
FIG. 1 is a schematic cross section of a floater comprising a mooring assembly according to the invention.

FIG. 1 shows a floater which has a deck 2 and a bottom 3. Between the bottom 3 and the deck 2 there is a throughgoing vertical shaft 4 wherein there is rotatably mounted a rotating part 5. The rotating part 5 is mounted for rotational movement about a vertical axis in the vertical throughgoing shaft 4 by means of slide bearings 6, 7 and 8.

The vertical shaft 4 is at its upper end covered by a top 10. This top 10 has a central aperture for letting through a central tube 9 protruding from the rotating part 5.

In this case the rotating part 5 is provided with four vertical guide tracks 11 which are evenly distributed along its circumference. In FIG. 1 only two such vertical tracks 11 are shown. At the bottom of each track 11 there is mounted a universal joint 12, whereby an elongated rigid body 13 is swivel-mounted in the rotating part 5.

The rigid body 13 is, as illustrated, at one end connected to the swivel joint 12 and at its other end, protruding down into the sea, provided with an activable chain stopper 14.

In connection with the rigid body 13, illustrated on the left-hand side of FIG. 1, there is shown a mooring cable 15, extending from moorings on the seabed. The mooring cable 15 is continued as a length of chain 16 through the chain stopper 14 and the rigid body 13, and further up to a winch 17 on the deck 2 of the floater. The purpose of the length of chain 16 is to make possible a locking of the mooring cable to the rigid body by means of an activable chain stopper 14. Obviously, it is also conceivable that the mooring cable may continue as a regular cable up through the stopper 14 and the rigid body 13, and up to the winch 17, which in that case is a regular line winch, but the stopper 14 must then be correspondingly formed, i.e., as an activable stopper intended to retain a line or a cable fixedly.

After the mooring cable has been tightened sufficiently, it is locked to the rigid body 13 and thereby to the rotating part 5 by means of the stopper 14. The connection with the winch 17 can then be slackened or, optionally, broken. The latter situation is shown at the right-hand side of FIG. 1, where the chain 16 has been broken and is suspended from the stopper 14. Optionally, from such a broken length of chain a pilot line may be extended to the rotating part and up through the track 11, so that the length of chain 16 may be retrieved and connected to a winch if a change in the tension of the mooring cable is desired.

It is quite possible to make use of different forms of mooring cables here, both pure steel wires and chains, or combinations thereof, and so forth, since the essential matter is to obtain a locking of the mooring cable to the rigid body so that the latter will function as a connecting element and a pointing element between the mooring cable and the rotating part 5.

A mooring cable extending upward from the seabed to a floater will be of considerable length, and it will often prove impossible to avoid the occurrence of some twist and turn of the mooring cable. This is obviously undesirable. By mounting the winch 17 rotatably about an approximately vertical axis coinciding with the extension of the cable toward the winch, a twist or turn of the mooring cable can be eliminated. This can be achieved by the winch 17 being rotatably mounted, for example by means of a turntable, so that it can be rotated with a corresponding rotation of the connected mooring cable. In FIG. 1 the position the winch 17 will occupy after a 180° rotation is shown by dotted lines; see also FIG. 2. By rotation of the winch, the undesirable twist of the cable can be removed.

Figure 2:
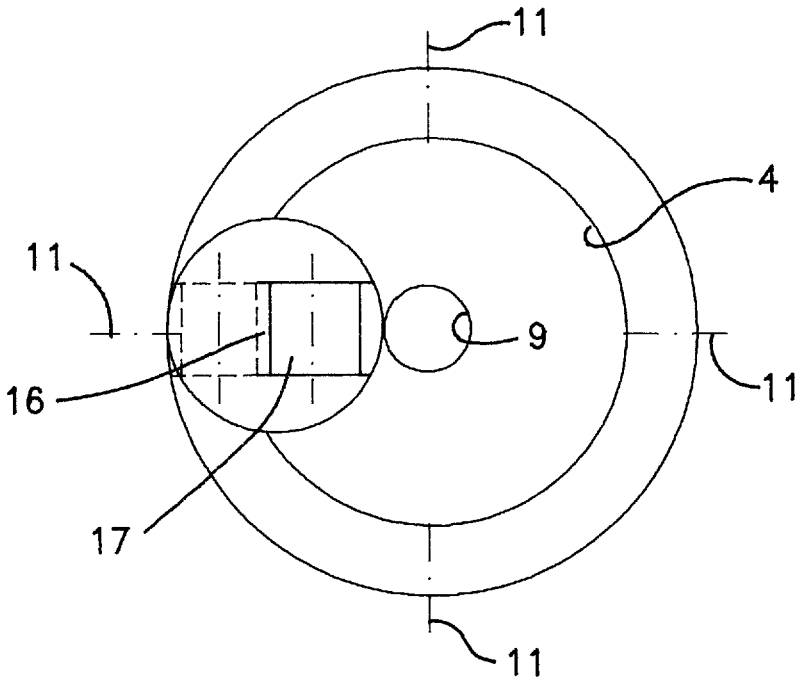
FIG. 2 is a schematic plan view of the mooring assembly of FIG. 1.

The whole of the winch, with a pertaining turntable or similar apparatus, can be moved round the whole circle, as indicated in FIG. 2, so that one and the same winch 17 thus can be used sequentially for tightening/slackening successive mooring cables 15, 16, brought up through the respective vertical guide tracks 11 in the rotating part 5.

Figure 3:
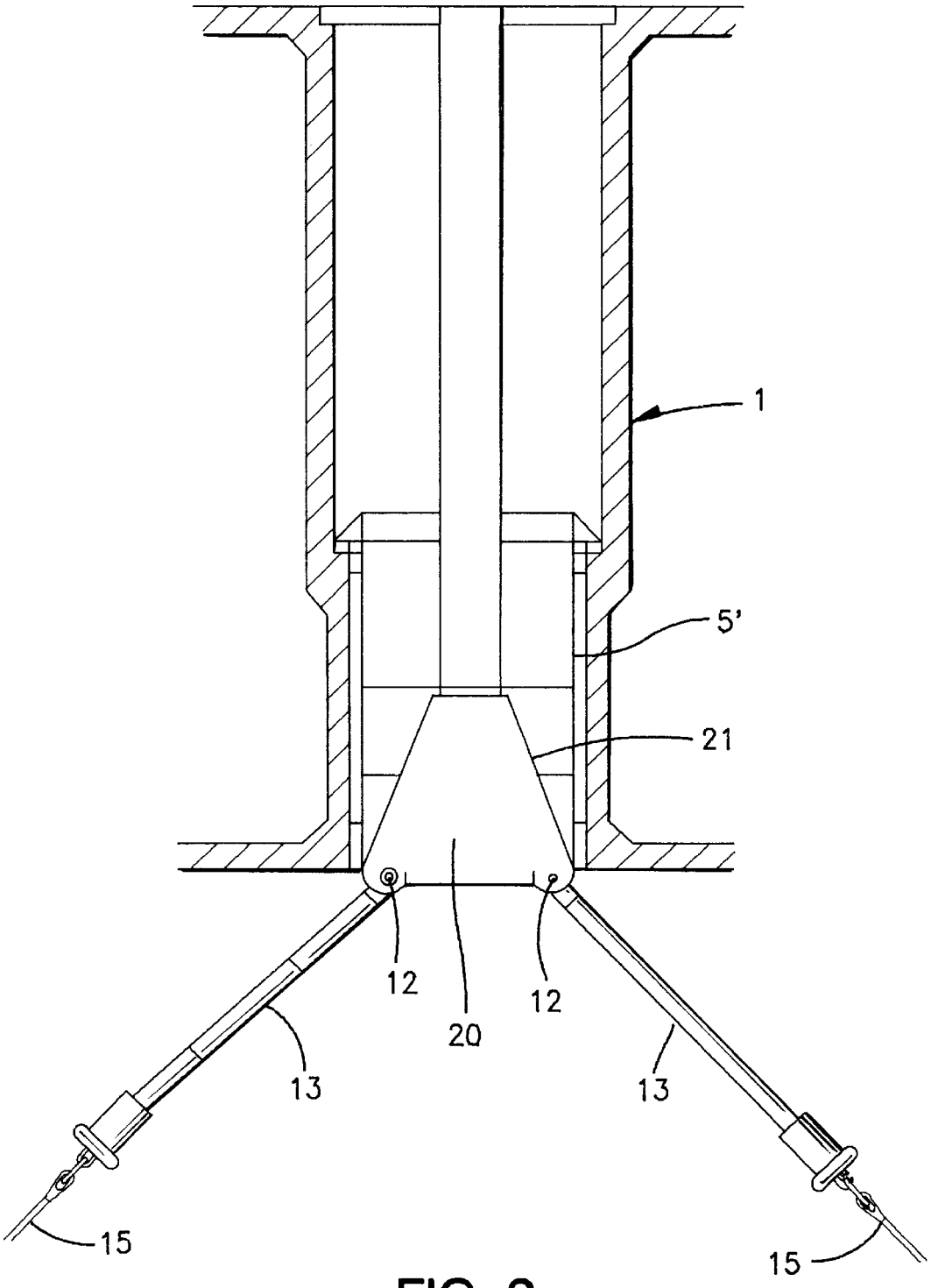
FIG. 3 shows a modified mooring assembly according to the invention.

FIG. 3 shows a possible embodiment according to the invention where the mooring cables are attached to a buoy 20. In the rotating part 5' there is formed a conical reception site 21 for the buoy 20. Here one uses prior art involving a buoy moored in a submerged state, capable of being raised under the floater and connected thereto, i.e., to a rotating part of the floater. Optionally, the buoy may constitute a rotating part in itself, since the buoy may be in two parts, one part being connected to the mooring cables and rotatably mounted in an exterior part, which is fixedly connected to the floater.

What is claimed is:

1. A mooring assembly for a floater at sea, said assembly comprising a vertical shaft (4) in the floater (1), a rotating part (5) rotatably mounted about a vertical axis in the vertical shaft, a number of mooring cables (16) extending from the rotating part down to the seabed, and means (17) aboard the floater (1) for tightening/slackening the mooring cables, wherein each mooring cable (15, 16) right below the rotating part (5) is secured to a rigid body (13) having two ends, one end being connected by a universal swivel joint (12) to said rotating part (5) and the other end comprising a locking device (14) for locking the mooring line to the rigid body (13).

2. A mooring assembly according to claim 1, wherein the rotational bearings of the rotating part (5) in the floater (1, 4) comprise slide bearings (6, 7, 8).

3. A mooring assembly according to claim 1, wherein said locking device (14) is an activable chain stopper.

4. A mooring assembly according to claim 1, wherein there, from each location (12) on the rotating part (5) to which the rigid body (13) there is connected, is formed a vertical guidance track (11) in the rotating part (5) for an elongated flexible element (16) extending from a tightening/slackening device (17) mounted on the floater (1), said tightening/slackening device (17) being rotatable about an axis, at least approximately vertical, coinciding with the extension of the flexible element (16) toward the device, for removal of any possible twist in the flexible element, which is connected to the mooring cable (15) or constitutes the mooring cable.

5. The mooring assembly according to claim 4, wherein the tightening/slackening device (17) is movable along and within the circumference of the vertical shaft (4).

6. A mooring assembly according to claim 1, wherein the rigid body at said one end is connected by a universal swivel joint to the rotating part via a buoy (20) moored by means of the mooring cables and capable of being brought into a locking engagement with the rotating part.

* * * * *